US009394588B2

(12) United States Patent
Matsuo et al.

(10) Patent No.: US 9,394,588 B2
(45) Date of Patent: Jul. 19, 2016

(54) TERMINAL, WIRE CONNECTING STRUCTURE AND METHOD OF MANUFACTURING A TERMINAL

(71) Applicants: Furukawa Electric Co., Ltd., Tokyo (JP); Furukawa Automotive Systems Inc., Shiga (JP)

(72) Inventors: Ryosuke Matsuo, Tokyo (JP); Akira Tachibana, Tokyo (JP); Kengo Mitose, Tokyo (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 0 days.

(21) Appl. No.: 14/831,686

(22) Filed: Aug. 20, 2015

(65) Prior Publication Data

US 2015/0357725 A1 Dec. 10, 2015

Related U.S. Application Data

(63) Continuation of application No. PCT/JP2014/050147, filed on Jan. 8, 2014.

(30) Foreign Application Priority Data

Feb. 23, 2013 (JP) ..... 2013-034024

(51) Int. Cl.
*H01R 4/10* (2006.01)
*C22C 9/00* (2006.01)
(Continued)

(52) U.S. Cl.
CPC ... *C22C 9/00* (2013.01); *C22C 9/02* (2013.01); *C22C 9/06* (2013.01); *H01R 4/187* (2013.01);
(Continued)

(58) Field of Classification Search
CPC ..... H01R 4/185; H01R 4/188; H01R 43/048
USPC ..... 439/877, 882, 874; 29/861
See application file for complete search history.

(56) References Cited

U.S. PATENT DOCUMENTS 4,966,565 A 10/1990 Dohi
7,905,745 B2 * 3/2011 Watanabe ..... H01R 4/62 439/442

(Continued)

FOREIGN PATENT DOCUMENTS

EP 2610359 A1 7/2013
EP 2612934 A1 7/2013

(Continued)

OTHER PUBLICATIONS

International Search Report and Written Opinion dated Mar. 25, 2014 for PCT/JP2014/050147.

(Continued)

*Primary Examiner* — Phuong Dinh
(74) *Attorney, Agent, or Firm* — Thompson Coburn LLP

(57) ABSTRACT

A terminal includes a connector portion electrically connectable to an external terminal, a tubular crimp portion formed integrally or separate from the connector portion and crimps with a wire, and a transition portion coupling the two. The tubular crimp portion of a copper or copper alloy metal base material or a metal member having the same is a tubular member closed on transition portion side and reduces in diameter towards the transition portion side such that a conductor-end portion of the electric wire is un-exposed. The tubular crimp portion has a belt-shaped weld portion along a longitudinal direction of the tubular crimp portion. A circumferential direction of the tubular crimp portion matches the RD-direction of the base material. A sum of area ratios R1, R2 and R3 in a rolling plane of the base material, of Cube-, RDW-, and Goss-oriented crystal grains, respectively, is greater than or equal to 15%.

11 Claims, 6 Drawing Sheets

(51) Int. Cl.

| | |
|---|---|
| ***H01R 43/048*** | (2006.01) |
| ***H01R 43/02*** | (2006.01) |
| ***C22C 9/02*** | (2006.01) |
| ***C22C 9/06*** | (2006.01) |
| ***H01R 4/18*** | (2006.01) |
| ***H01R 13/03*** | (2006.01) |
| *H01R 4/20* | (2006.01) |
| *H01R 4/62* | (2006.01) |

(52) U.S. Cl.

CPC ..... *H01R 13/03* (2013.01); *H01R 43/02* (2013.01); *H01R 43/048* (2013.01); *H01R 4/20* (2013.01); *H01R 4/62* (2013.01); *Y10T 29/49215* (2015.01)

(56) References Cited

U.S. PATENT DOCUMENTS

| | | | | |
|---|---|---|---|---|
| 2012/0325552 | A1 | 12/2012 | Sakura | |
| 2013/0220698 | A1 | 8/2013 | Takayama et al. | |
| 2015/0364833 | A1* | 12/2015 | Tonoike | H01R 4/183 439/879 |
| 2015/0364836 | A1* | 12/2015 | Yagi | B23K 26/32 439/877 |

FOREIGN PATENT DOCUMENTS

| | | | |
|---|---|---|---|
| JP | H02-103876 | A | 4/1990 |
| JP | 2004-071437 | A | 3/2004 |
| JP | 2004-207172 | A | 7/2004 |
| JP | 2010-123449 | A | 6/2010 |
| JP | 2011-117034 | A | 6/2011 |
| JP | 2011-222243 | A | 11/2011 |
| JP | 2012-003856 | A | 1/2012 |
| JP | 2012-084471 | A | 4/2012 |
| JP | 2012177197 | A | 9/2012 |
| JP | 2013-030338 | A | 2/2013 |
| JP | 2013-062205 | A | 4/2013 |
| KR | 10-2014-0126782 | A | 10/2014 |
| WO | 2012/026611 | A1 | 3/2012 |
| WO | 2012/029717 | A1 | 3/2012 |
| WO | 2012/107873 | A1 | 8/2012 |

OTHER PUBLICATIONS

Notice of Reasons for Rejection received on Mar. 17, 2014 for Japanese Patent Application No. 2014-506656.

Decision to Grant a Patent received on Jun. 2, 2014 for Japanese Patent Application No. 2014-506656.

Notice of Allowance dated Nov. 18, 2014 in corresponding Korean Application No. 10-2014-7029035.

English Translation of Written Opinion dated Mar. 25, 2014 for PCT/JP2014/050147.

Extended European Search Report dated Apr. 28, 2016 in a counterpart European Application No. 14753825.0.

* cited by examiner

TERMINAL, WIRE CONNECTING STRUCTURE AND METHOD OF MANUFACTURING A TERMINAL

This is a continuation application of International Patent Application No. PCT/JP2014/050147, filed Jan. 8, 2014, which claims the benefit of Japanese Patent Application No. 2013-034024, filed Feb. 23, 2013. This application is entitled to participation in the patent prosecution highway program because of corresponding Japanese Patent Application No. 2014-506656, which claims the benefit of International Patent Application No. PCT/JP2014/050147, filed Jan. 8, 2014, which claims the benefit of Japanese Patent Application No. 2013-034024, filed Feb. 23, 2013, the full contents of all of which are hereby incorporated by reference in their entirety.

BACKGROUND

1. Technical Field

The present disclosure relates to a terminal that enables an electric connection with the outside, wire connecting structure and a method of manufacturing a terminal, and particularly relates to a terminal made of copper or a copper alloy that is attached to an electric wire, a wire connecting structure and a method of manufacturing a terminal.

2. Background Art

In the field of vehicles, in view of improving fuel consumption, there is a need for lightweighting of various components constituting automobiles. Particularly, a wire harness used in automobiles is a component having a second heaviest weight next to an engine in an automobile and thus, for lightweighting, there have been efforts to change a material of a conductor (core wire) of an electric wire used in the wire harness from copper to one of aluminum and an aluminum alloy. Normally, a base material made of one of copper and a copper alloy is used for a terminal connected to a leading end portion of an aluminum or aluminum alloy wire. Accordingly, since there is a possibility that exposed aluminum produces dissimilar metal corrosion and the conductor becomes defective at a connecting portion between the conductor and the terminal that are made of the aforementioned materials, it is necessary to take measures such as to shield the aluminum conductor from the outside world.

To this end, it is known to mold an entire crimp portion with a resin (Japanese Laid-Open Patent Publication No. 2011-222243). However, this results in a bulky connector since the size of a connector housing needs to be larger because of a bulky mold portion, and thus a wire harness as a whole cannot be miniaturized or have a higher density.

With a molding method, since individual crimp portion is processed after the crimping of an electric wire, there is a problem that manufacturing processes of a wire harness may largely increase or become cumbersome.

In order to solve such a problem, there are proposed techniques such as a technique in which a metal cap is placed to cover the electric wire conductor and thereafter crimped to thereby bring an aluminum conductor into a sealed state (Japanese Laid-Open Patent Publication No. 2004-207172) and a technique in which a crimp terminal and a metal cap are not provided as separate components but rather an electric wire is covered with a part of a strip of terminal to provide a sealed state (Japanese Laid-Open Patent Publication No. 2012-84471).

In the manufacture of a tubular member for crimping an electric wire including an aluminum conductor in a covered state, a method that includes bending a part of a pressed plate into a tubular shape and welding a butted portion or a lapped portion of end portions thereof by laser is advantageous in respect of both shaping and productivity. However, when laser welding is performed, since the weld portion is forcibly dissolved rapidly and then rapidly solidified, a strain is produced in the weld portion. This strain affects adhesion between the crimp portion and an electric wire, and particularly, it is difficult to maintain reliability after aging.

The present disclosure is related to a terminal that can improve adhesion between the tubular crimp portion and an electric wire and reliability can be maintained for a long term, a wire connecting structure and a method of manufacturing a terminal.

SUMMARY

According to a first aspect of the present disclosure, a terminal includes a connector portion electrically connectable to an external terminal, a tubular crimp portion extending form the connector portion, and a transition portion that couples the connector portion and the tubular crimp portion. The tubular crimp portion is integral with the connector portion or coupled to the connector portion distinct therefrom. The tubular crimp portion is adapted to be crimped onto an electric wire. The tubular crimp portion has a longitudinal direction and a circumferential direction. The tubular crimp portion comprises one of a metal base material and a metal member having the metal base material. The metal base material is composed of one of copper and a copper alloy. The tubular crimp portion is a tubular member having a closed transition portion and an electric wire insertion opening side. The electric wire insertion opening side is adapted to receive and encompass a conductor end portion of an electric wire. The electric wire insertion opening side having a first width and the transition portion having a second width, the second width being less than the first width. The tubular crimp portion has a belt-shaped weld portion formed along a direction that is substantially the same as the longitudinal direction of the tubular crimp portion. A RD-direction of the metal base material is substantially aligned with the circumferential direction of the tubular crimp portion. A sum of area ratios R1, R2 and R3 is greater than or equal to 15%, where R1, R2 and R3 are area ratios of crystal grains in the metal base material oriented substantially in Cube orientation, RDW orientation, and Goss orientation, respectively, facing a (100) plane of a face centered cubic lattice with respect to the RD-direction.

According to a second aspect of the present disclosure, a wire connecting structure comprises a terminal and an electric wire. The terminal includes a connector portion electrically connectable to an external terminal, a tubular crimp portion that is integral with the connector portion or coupled to the connector portion distinct therefrom, and a transition portion that couples the connector portion and the tubular crimp portion. The tubular crimp portion is crimped onto the electric wire. The tubular crimp portion is formed of one of a metal base material and a metal member having the metal base material. The metal base material is composed of one of copper and a copper alloy. The tubular crimp portion is a tubular member having a closed transition portion and an electric wire insertion opening side. The electric wire insertion opening side encompasses a conductor end portion of the electric wire. The electric wire insertion opening side has a first width and the transition portion has a second width, the second width being less than the first width. The tubular crimp portion has a belt-shaped weld portion formed along a direction that is substantially the same as the longitudinal direction of the tubular crimp portion. A RD-direction of the metal base material is substantially aligned with the circumferential direction of the tubular crimp portion. A sum of area ratios R1, R2 and R3 is greater than or equal to 15%, where R1, R2 and R3 are area ratios of crystal grains in the metal base material substantially oriented in Cube orientation, RDW orientation, and Goss orientation, respectively, facing a (100) plane of a face centered cubic lattice with respect to the RD-direction.

According to a third aspect of the present disclosure, a method of manufacturing a terminal having a connector portion electrically connectable to an external terminal, a tubular crimp portion being integral with the connector portion or coupled to the connector portion distinct therefrom, and a transition portion that couples the connector portion and the tubular crimp portion. The tubular crimp portion is adapted to be crimped onto an electric wire. The tubular crimp portion has an electric wire insertion opening side. The electric wire insertion opening side has a first width and the transition portion has a second width. The method comprises forming a metal base material in which a sum of area ratios R1, R2 and R3 being greater than or equal to 15%, where R1, R2 and R3 are area ratios of crystal grains in the metal base material oriented in Cube orientation, RDW orientation, and Goss orientation, respectively, facing a (100) plane of a face centered cubic lattice with respect to the RD-direction. The method further comprises pressing the metal base material to form a tubular body in such a manner that a RD-direction of the metal base material is substantially the same as a circumferential direction of the tubular crimp portion. The method further comprises welding a butted portion of the tubular body to form the tubular crimp portion in such a shape that the tubular body is closed at the transition portion and reduces in width away from the electric wire insertion opening side and towards the transition portion. The tubular crimp portion is formed so as to enable a conductor end portion of an electric wire to be received and encompassed by the electric wire insertion opening, and forming on the tubular body a belt-shaped weld portion in a direction substantially the same as a longitudinal direction of the tubular body.

According to a fourth aspect of the present disclosure, a method of manufacturing a terminal having a connector portion electrically connectable to an external terminal, a tubular crimp portion that is integral with the connector portion or coupled to the connector portion distinct therefrom, and a transition portion that couples the connector portion and the tubular crimp portion. The tubular crimp portion is adapted to be crimped onto an electric wire. The method comprises forming a metal base material in which a sum of area ratios R1, R2 and R3 is at least equal to 15%, where R1, R2 and R3 are area ratios of crystal grains in the metal base material oriented in Cube orientation, RDW orientation, and Goss orientation, respectively, facing a (100) plane of a face centered cubic lattice with respect to the RD-direction. The method further comprises providing a metal layer on the metal base material to form a metal member. The method further comprises pressing the metal member to form a tubular body in such a manner that a RD-direction of the base material is substantially the same as a circumferential direction of a tubular crimp portion. The method further comprises welding a butted portion of the tubular body to form the tubular crimp portion in such a shape that the tubular body is closed at the transition portion and reduces in width from the electric wire insertion opening side towards the transition portion. The tubular crimp portion is formed so as to enable a conductor end portion of an electric wire to be received and encompassed by the electric wire insertion opening side, and forming on the tubular body a belt-shaped weld portion in a direction substantially the same as a longitudinal direction of the tubular body.

DETAILED DESCRIPTION

Hereinafter, an embodiment of the present disclosure will be described in detail with reference to the accompanying drawings.

Figure 1:
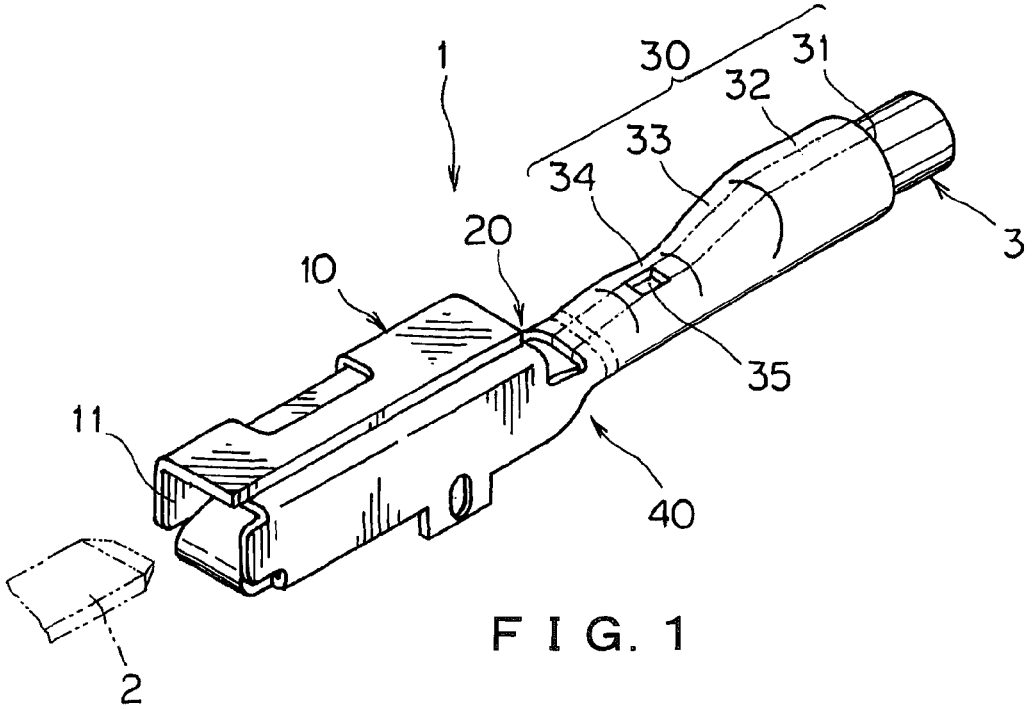
FIG. 1 is a perspective view schematically showing a configuration of a wire connecting structure having a terminal according to an embodiment of the present disclosure.

FIG. 1 is a diagram schematically showing a configuration of a wire connecting structure having a terminal according to an embodiment of the present disclosure. A wire connecting structure and a terminal in FIG. 1 are shown by way of example, and configurations of respective portions according to the present disclosure are not limited to those shown FIG. 1.

A wire connecting structure 1 of the present disclosure includes a terminal 40 and an electric wire 3 that are electrically and mechanically joined together. More specifically, it is formed integrally with a base material of copper or a copper alloy and is attached to the electric wire 3 that has a conductor (core wire) made of aluminum or an aluminum alloy and an insulation coating layer covering a periphery of the conductor. One or a plurality of such wire connecting structures are bundled and a terminal portion is accommodated in a connector housing as needed to form a wire harness. Hereinafter, such a terminal portion (terminal 40) will be described.

The terminal 40 of the present disclosure includes a connector portion 10 to be electrically connected to an external terminal 2 and a tubular crimp portion 30 that is provided via the connector portion and a transition portion 20 and to be crimped to the electric wire 3. In the present embodiment, the tubular crimp portion 30 and the connector portion 10 are integrally formed. However, the connector portion and the tubular crimp portion may also be formed as separate bodies and a terminal may be fabricated by coupling them.

Further, the terminal 40 may be made of a metal member to ensure conductivity and strength. The metal member includes a base material of a metal material (copper, aluminum, iron or an alloys based on them) and a metal layer optionally provided on a surface thereof. The metal layer may be provided on a part or an entirety of the metal base material, and tin or noble metals such as silver and gold are desirable from the viewpoint of contact property and environment resistant property. The metal layer may be one or more layers and, for example, a base coating of iron (Fe), nickel (Ni), cobalt (Co) or an alloy based on them may be further provided. In consideration of protection, cost, or the like of the metal base material, the metal layer has a thickness of 0.3 μm to 1.2 μm in total. When a part of the metal base material is provided on the metal layer, the metal layer is formed into a shape such as stripes or spots. The metal layer is usually provided by plating, but it is not limited thereto.

Figure 9:
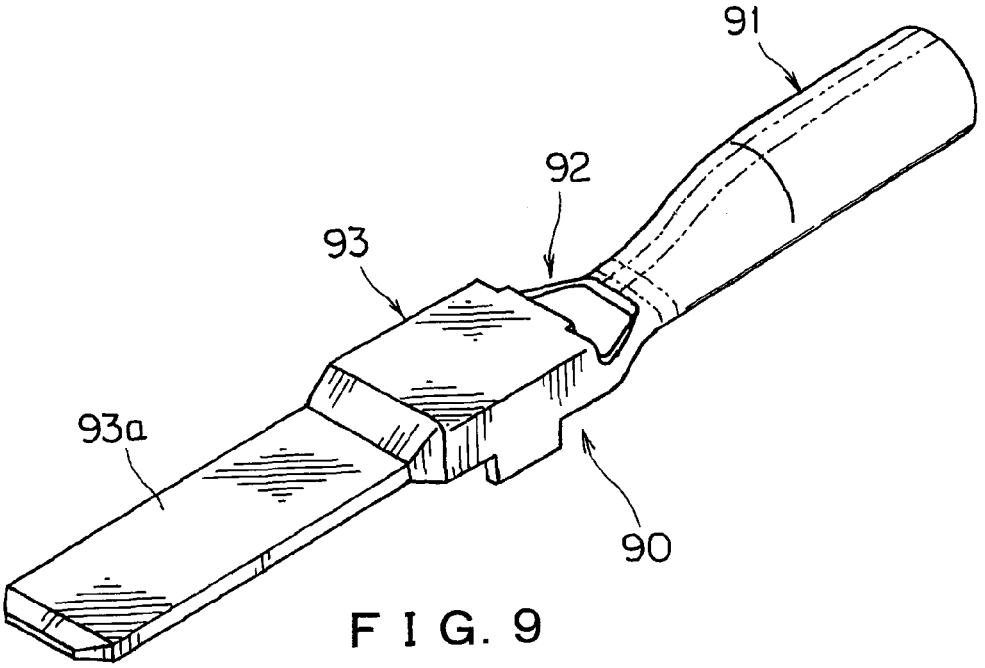
FIG. 9 is a perspective view showing another variant of the terminal according to the present embodiment.

A connector portion 10 is a box portion that allows, for example, insertion of an insertion tab such as a male terminal. In the present disclosure, the shape of a details of this box portion is not particularly limited. For example, as shown in FIG. 9, as another embodiment of the terminal of the present disclosure, the terminal may be of a structure that has an insertion tab 93*a* (elongated-shaped connecting portion) of the male terminal. That is, the connector portion 10 may be of any shape as long as it can be engaged or fitted with and electrically connected to an external terminal. In the present embodiment, an example of a female terminal is shown for the sake of convenience of explaining the terminal of the present disclosure.

The tubular crimp portion 30 is a tubular member that is closed on a transition portion 20 side, and has an insertion opening 31 through which the electric wire 3 is inserted, a coating crimp portion 32 that crimps with an insulation coating of the electric wire 3, a reduced-diameter portion 33 having a diameter that reduces from an insertion opening 31 side towards the transition portion 20 side, and a conductor crimp portion 34 that crimps with a conductor of the electric wire 3. The tubular crimp portion 30 is, for example, formed into a tubular shape having one end closed by welding. More specifically, a metal base material or a metal member developed in a plane is pressed three-dimensionally to form a tubular body having a substantially C-shaped cross section and an open part (butted portion) of the tubular body is welded. Since welding is performed along a longitudinal direction of the tubular body, a tubular crimp portion is formed with a belt-shaped weld portion (weld bead) being formed in a direction substantially the same as a longitudinal direction of the tubular body. Also, after the welding for forming a tubular crimp portion, it is desirable for an end portion of the tubular crimp portion of the transition portion side to be sealed by welding. The sealing is performed in a direction perpendicular to the longitudinal direction of the terminal. With such a sealing, moisture or the like can be prevented from entering from the transition portion 20 side.

At the tubular crimp portion 30, with an electric wire end portion at which a conductor is exposed being inserted into an insertion opening 31, the tubular crimp portion 30 is crimped such that the coating crimp portion 32, the reduced-diameter portion 33 and the conductor crimp portion 34 deform plastically and crimp with an insulation coating and a conductor of the electric wire 3. Thus, the tubular crimp portion 30 and the conductor of the electric wire 3 are electrically connected. A recessed portion 35 may be formed at a part of the conductor crimp portion 34 by pressing strongly.

Note that the transition portion 20 is a portion that bridges between the connector portion 10 and the tubular crimp portion 30. It can be formed three-dimensionally or formed in a planar manner. Considering a mechanical strength against folding in a longitudinal direction of the terminal, it should be designed in such a manner that a second moment of area in a longitudinal direction increases.

Figure 2:
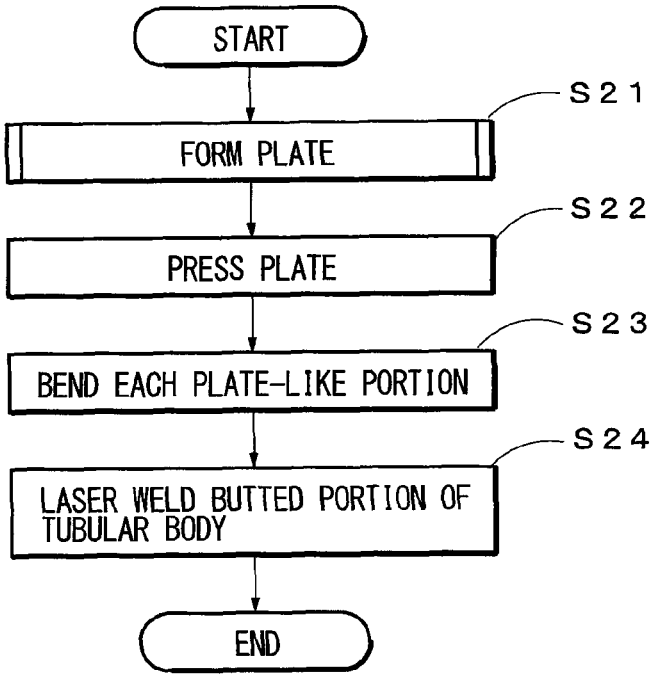
FIG. 2 is a flow chart showing a method of manufacturing the terminal according to the present embodiment.

FIG. 2 is a flow chart showing a method of manufacturing the terminal shown in FIG. 1, and FIGS. 3A to 3D are plan views for explaining a method of manufacturing the terminal of FIG. 1. Note that FIG. 3 is a diagram viewed from a ND direction (a direction perpendicular to a plate surface) of the plate and showing how a terminal is manufactured from a plate 41 (terminal plank).

Figure 3A:
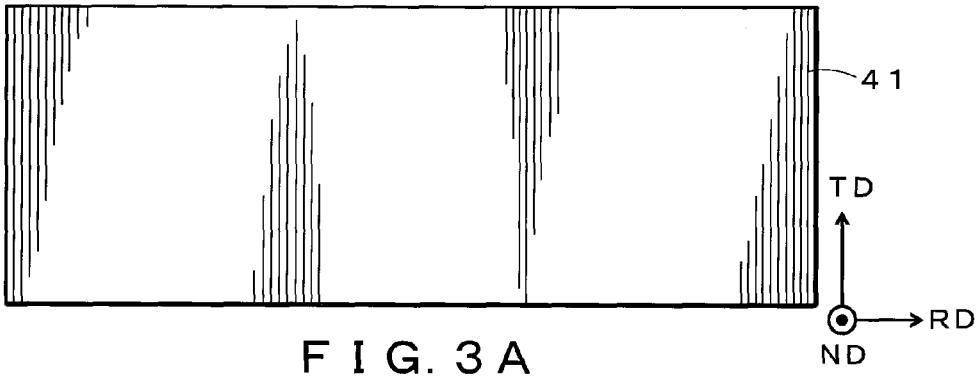
FIGS. 3A to 3D are plan views for explaining a method of manufacturing the terminal.

Firstly, a plate composed of a metal base material of copper or a copper alloy is rolled to fabricate a metal plate 41 of a predetermined thickness, e.g., 0.25 mm (step S21). Here, a RD-direction (rolling direction) of the base material refers to a longitudinal direction of a plate composed of a metal base material (FIG. 3A). As needed, a metal layer is provided on an entirety of the plate 41 composed of a metal base material to form a metal member, or alternatively, a metal layer is provided at an arbitrary portion with the plate 41 composed of the metal base material being masked to form a metal member. It is preferable to form the metal layer with a plating process. A material of the metal layer may be, for example, a tin, silver, or gold plating.

Figure 3B:
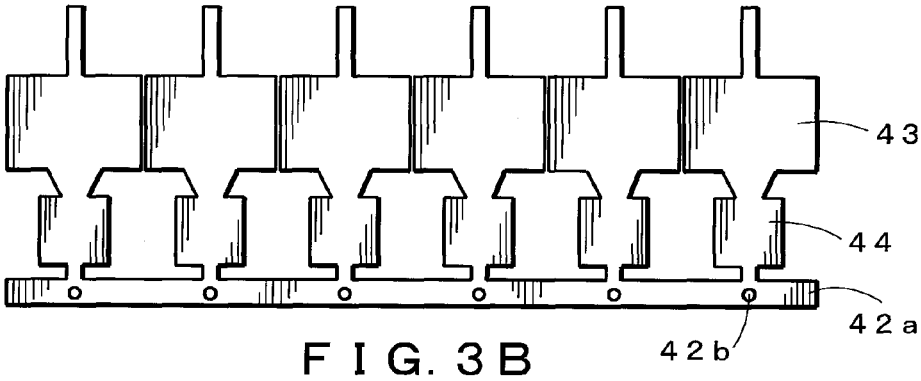

The plate 41 composed of the metal base material (or a plate composed of the metal member) is punched into a repeated shape by a pressing process (primary press) such that a plurality of terminals are in a planar developed state (step S22). With this pressing process, a workpiece of a so-called open side type in which each workpiece is supported at one end is manufactured, and a plate-like body for connector portion 43 and a plate-like body for crimp portion 44 are formed integrally with a carrier portion 42*a* having perforations 42*b* formed at an equal interval (FIG. 3B). Punching is performed such that plate-shaped portions (terminal blank) that become constituent units of the repeated geometry are arranged at a predetermined pitch in the RD-direction, and a longitudinal direction of a tubular crimp portion formed later is generally perpendicular (TD direction) to the RD-direction. A metal layer may be provided on the metal base material after such a pressing process to obtain a metal member. That is, a plating process may be applied after the pressing process.

Figure 3C:
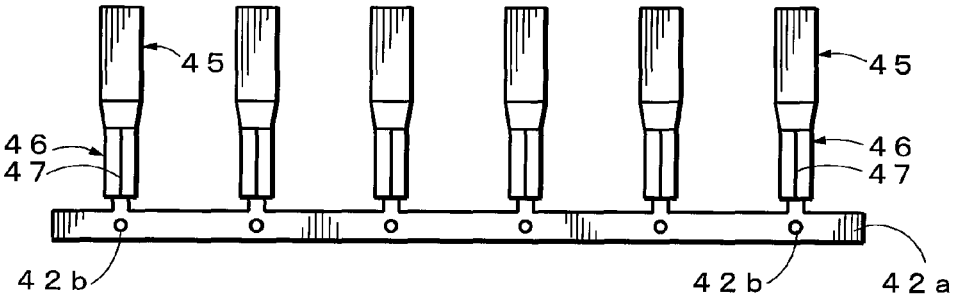

Then, a bending process is applied on each plate-shaped portion that becomes a constituent unit of the repeated shape (secondary press) to form a connector portion 45 and a tubular body 46 to be made into a tubular crimp portion (step S23). At this time, a cross section perpendicular to the longitudinal direction of the tubular body for crimp portion 46 has a substantially C-shape with an extremely small gap. End surfaces of the base material across this gap are referred to as a butted portion 47 (FIG. 3C). The butted portion 47 extends in a TD direction.

Figure 3D:
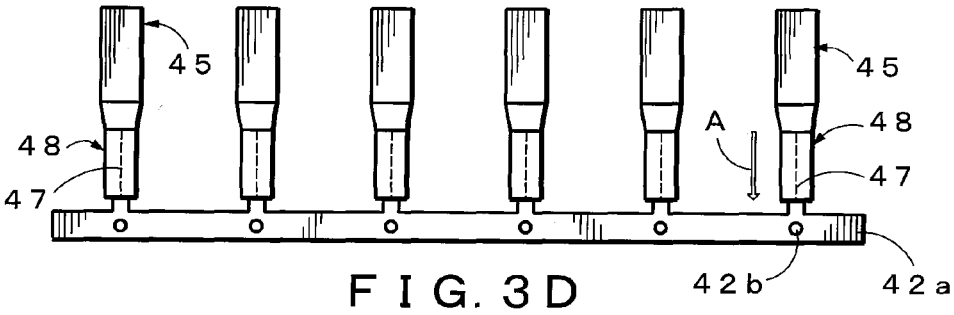

Thereafter, for example, laser is irradiated from above the tubular body for crimp portion 46 and swept in a direction of an arrow A in the figure along the butted portion 47 and laser welding is applied to such a portion (FIG. 3D, step S34). Thereby, the butted portion 47 adheres by welding, and a tubular crimp portion 48 is formed. With a laser welding, a belt-shaped weld portion (weld bead) is formed as a welding trace. Such a laser welding is performed using a fiber laser to be described below. The reduced-diameter portion of the tubular body or the like can be welded three-dimensionally by using a laser welder in which a focal position during the welding can be adjusted three-dimensionally.

Figure 4A:
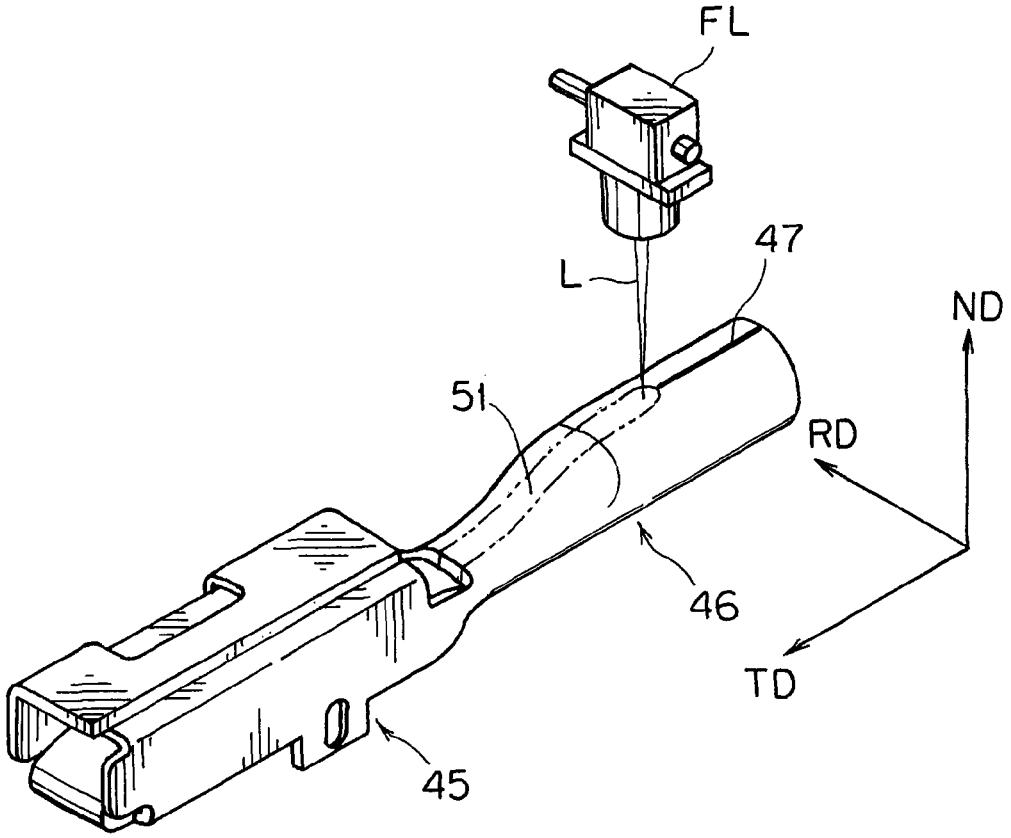
FIG. 4A is a perspective view for explaining a laser welding process in FIG. 2.
Figure 4B:
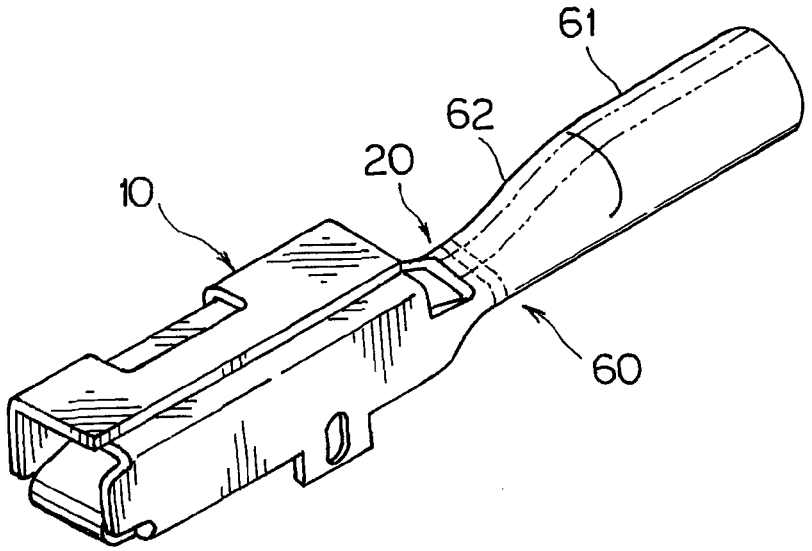
FIG. 4B is a perspective view showing a configuration of the terminal manufactured by a manufacturing method of FIG. 2.

FIGS. 4A and 4B are perspective views for explaining a laser welding process of step S24 in FIG. 2.

As illustrated in FIGS. 4A and 4B, for example, in the present embodiment, a fiber laser welding apparatus FL is used, and, the butted portion 47 of the tubular body for crimp portion 46 is welded at a laser power of 300 W to 500 W, a sweep rate of 90 mm/sec to 180 mm/sec, and a spot diameter of approximately 20 μm. With laser L being irradiated along the butted portion 47, a belt-shaped weld portion 51 is formed at generally the same position as the butted portion 47. However, an interval of a gap between the end surfaces of the butted portion 47 and a width of the belt-shaped weld portion 51 do not necessarily match. Also, a circumferential direction of the tubular body for crimp portion 46 is substantially the same as the RD-direction of the base material. Therefore, the belt-shaped weld portion 51 is formed substantially perpendicularly to the RD-direction.

Also, after the welding with which the tubular crimp portion is formed, it is preferable that a transition portion side-end of the tubular crimp portion (an end portion on a side opposite to an electric wire insertion opening) is sealed by welding. The sealing is carried out in a direction perpendicular to a terminal longitudinal direction (tubular crimp portion longitudinal direction). With this welding, a portion where the metal base material (or the metal member) is lapped is welded from above the lapped portion. With such sealing, the transition portion side-end of the tubular crimp portion is closed.

As shown in FIG. 4B, a terminal 60, which is manufactured by the steps shown in FIGS. 3A to 3D, has a tubular crimp portion 61 having a belt-shaped weld portion which is generally formed along the same direction as the longitudinal direction and a reduced-diameter portion 62 having a diameter that reduces towards a transition portion side 20.

Figure 5A:
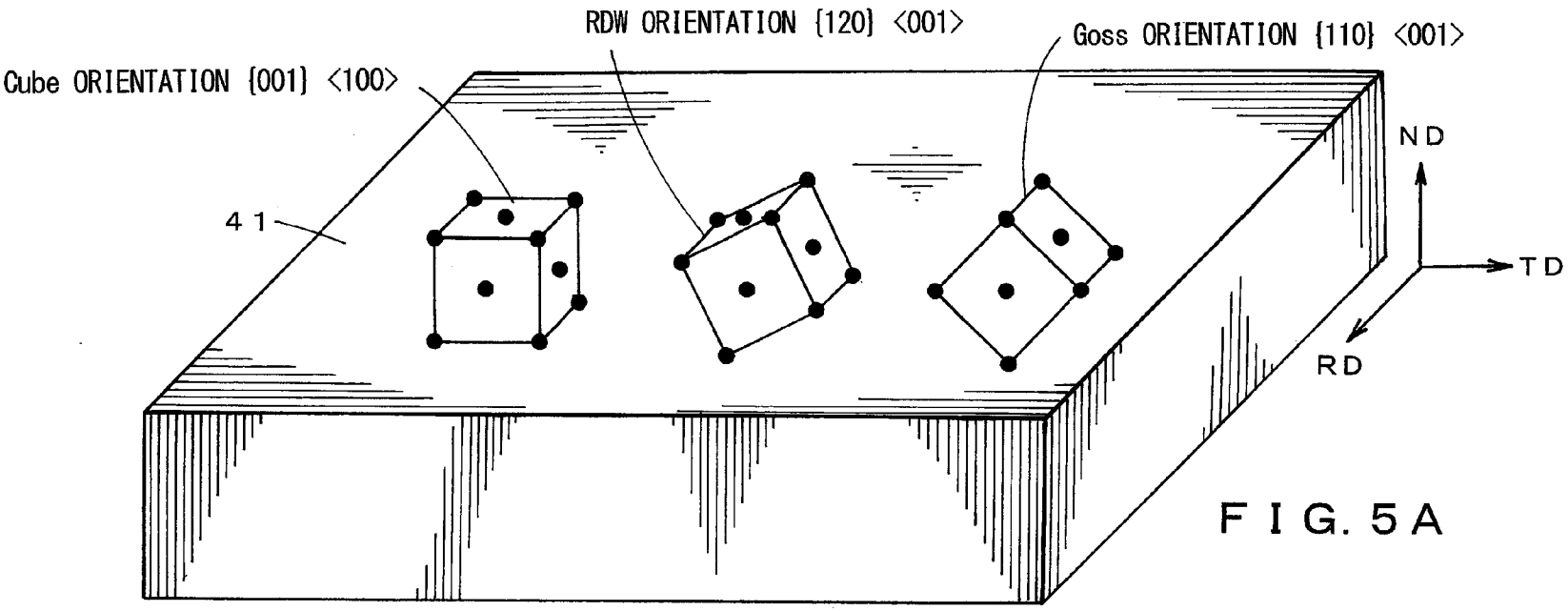
FIG. 5A is a schematic diagram for explaining orientations of crystal grains in a base material of a metal member in FIG. 3A.
Figure 5B:
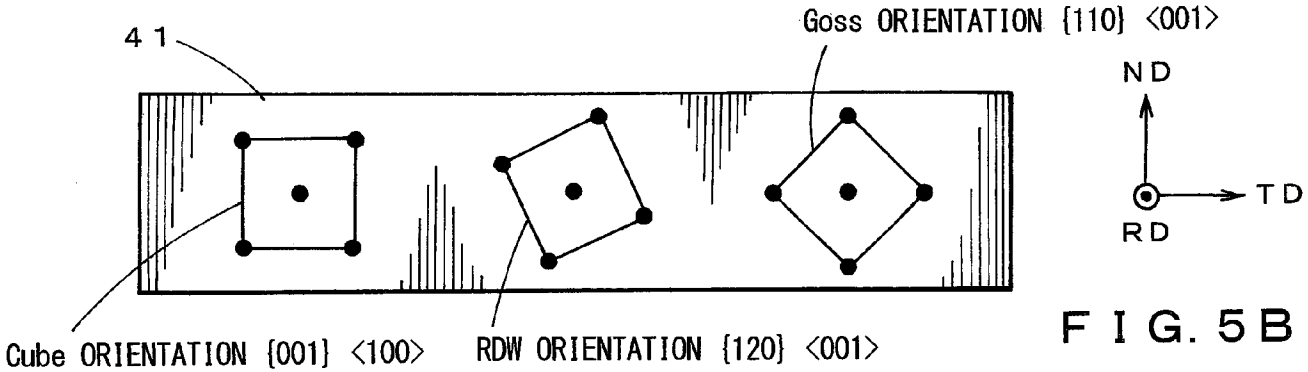
FIG. 5B is a diagram showing a plane perpendicular to a RD-direction of FIG. 5A.

FIGS. 5A and 5B are schematic diagrams for explaining orientations of crystal grains in a plate 41 composed of a metal base material or a metal member in FIG. 3A. It schematically shows that a crystal of copper has a face centered cubic (FCC) lattice structure and how such a centered cubic lattice is oriented as a crystal in a plate.

The plate 41 composed of the metal base material or the metal member used in the present embodiment has a crystal texture in which deformation is not likely to remain at the time of laser welding. Specifically, in the plate 41, crystals orientations of greater than or equal to a certain area are intentionally oriented. Particularly, a sum of area ratios R1, R2 and R3 of crystal grains oriented in Cube orientation {001}<100>, RDW orientation {120}<001>, and Goss orientation {110}<001>, respectively, which are facing a (100) plane of a face centered cubic lattice with respect to a RD-direction.

A direction of a plate composed of the metal base material and crystal orientation in the base material will be described. Most of industrially used metal plates (strip materials) for electric electronic components are manufactured by a rolling process. The metal material is usually a polycrystalline material, but crystals in a plate integrates in a particular orientation by repeating a rolling process for a plurality of times. A state of a metal structure integrated in a certain orientation is referred to as a texture. In order to discuss an aspect of the texture, a coordinate system for defining a crystalline direction is required. Accordingly, in the present specification, in accordance with a normal notation method of a general texture, a rectangular coordinate system is used in which X-axis represents a rolling direction (RD) in which a plate is rolled and advanced, Y-axis represent a plate width direction (TD) of the plate, and Z-axis represents a rolling normal direction (ND) which is perpendicular to a plate surface of the plate. An orientation of a certain single crystal grain existing in a plate of the metal base material is expressed as (hkl)[uvw] using a Miller index (hkl) of a crystal plane which is perpendicular to the Z-axis (parallel to a rolling plane) and an index [uvw] in a crystal orientation parallel to the X-axis. For example, it is shown as (132)[6-43] and (231)[3-46]. In other words, this indicates that a (132) plane of a crystal constructing the crystal grain is perpendicular to ND, and a [6-43] direction of a crystal constructing the crystal grain is parallel to RD. Note that (132)[6-43] and (231)[3-46] are equivalent due to a symmetric property of the face centered cubic lattice. A group of orientations having such an equivalent orientation is shown as {132}<643> using parenthesis notations ({ } and < >) to indicate the family.

As shown in FIGS. 5A and 5B, Cube orientation is, for example, a state in which a (001) plane is perpendicular to a rolling face normal direction (ND) and a [100] direction is directed in the rolling direction (RD), and represented by an index {001}<100>. RDW orientation is, for example, a state in which a (012) plane is perpendicular to a rolling face normal direction (ND), and a [100] direction is directed in the rolling direction (RD), and represented by an index {120}<001>. Goss orientation is, for example, a state in which a (011) plane is perpendicular to the rolling face normal direction (ND), and a [100] direction is directed in the rolling direction (RD), and represented by an index {110}<001>. However, those shown in FIGS. 5A and 5B are variant examples of the respective orientations, and not all variants that are equivalent from a crystallographical point of view are illustrated.

Note that the crystal orientation (hkl)[uvw] uniquely determines an orientation of the crystal, and does not depend on a viewing direction. In other words, a plate may be measured from the rolling direction (RD) or a plate may be measured from the rolling normal direction (ND). However, since the present disclosure is defined by an area ratio of crystal orientations, a specific observation field of view becomes necessary. According to the present disclosure, an area ratio is measured from the ND direction, unless otherwise specified. The field of view of measurement is observed such that there are at least around 200 crystal grains of material. That is, an area ratio of crystal orientation A according to the present disclosure is obtained by calculating an area of those having A-orientation in the observation field of view by an image analysis and dividing it by a total area of the field of view.

An EBSD method was used for any analysis of the crystal orientation of the present disclosure. EBSD is an abbreviation for Electron Back Scatter Diffraction (electron back scatter diffraction), which is a crystal orientation analysis technique utilizing a backscattered electron Kikuchi line diffraction (Kikuchi pattern) that is produced when a sample is irradiated with an electron beam in a Scanning Electron Microscope (SEM). In the present disclosure, orientation was analyzed by scanning a sample having an area with 500 μm on each side and containing 200 or more crystal grains at a step of 0.5 μm. Information obtained by the orientation analysis using EBSD includes orientation information up to a depth of a few to several tens of nanometers, which is a penetration depth of an electron beam into the sample. However, since it is sufficiently small with respect to an area which is being measured, it is described as an area ratio in the present specification.

As for the plate composed of a metal base material or a metal member that constitutes the terminal of the present disclosure, a sum of area ratios R1, R2 and R3 of crystal grains oriented in Cube orientation {001}<100>, RDW orientation {120}<001>, and Goss orientation {110}<001>, respectively, which are facing a (100) plane of a face centered cubic lattice with respect to an RD-direction. When the metal plate 41 composed of a metal base material (or a metal member) is a texture having an area ratio described above, since columnar crystals growing from the butted portion 47 at the time of welding grow parallel to a widthwise direction of the belt-shaped weld portion 51 and a percentage of the columnar crystals grow in such a manner increases, a heat strain in the belt-shaped weld portion 51 that is produced after condensation decreases and tensile residual stress decreases. Accordingly, even in a case where a tensile load stress is applied to the belt-shaped weld portion 51 due to plastic deformation at the time of crimping, it is possible to prevent a big tensile stress from being produced in the belt-shaped weld portion 51.

When calculating the sum of area ratios, the orientation of each crystal grain does not necessarily need to correspond with Cube orientation, RDCube orientation or Goss orientation, and a crystal grain having a deviation angle of ±10% from each orientation may be included in the calculation. Specifically, a Cube-oriented crystal grain may include a crystal grain that has a (001) plane which is at a ±10% deviation angle from Cube orientation. Also, a RDW-oriented crystal grain may include a crystal grain that has a (001) plane which is at a ±10% deviation angle from RDW orientation and a Goss-oriented crystal grain may include a crystal grain that has a (001) plane which is at a ±10% deviation angle from Goss orientation.

A method of manufacturing the plate 41 satisfying the aforementioned area ratio will be described with reference to FIG. 6. Note that the manufacturing method of FIG. 6 corresponds to a plate forming process of step 21 in FIG. 2.

Figure 6:
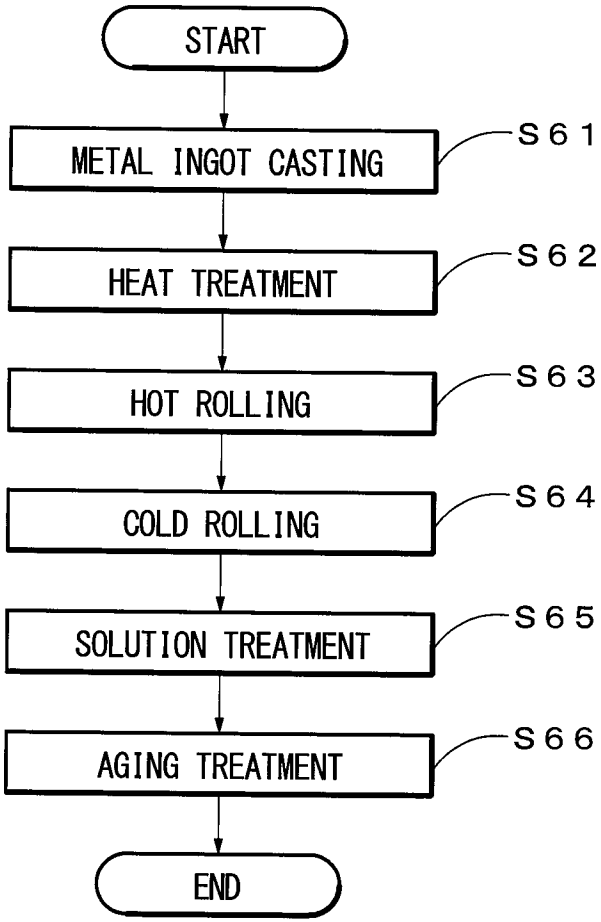
FIG. 6 is a flow chart showing an example of a forming process of the base material of the metal member of FIG. 2.

As shown in FIG. 6, firstly, a metal ingot of a copper alloy is cast (step S61) and then the metal ingot is subject to a heat treatment at a predetermined temperature and for a predetermined period of time (step S62). Then, hot rolling is performed at a temperature higher than a heat treatment temperature (step S63), and thereafter cold rolling is performed to form a plate of a desired thickness (step S64). Thereafter, a solution treatment (step S65) and an aging treatment (step S66) are performed to manufacture the plate 41. A plate manufactured by this process is preferably, a Cu—Ni—Si—Sn—Zn—Mg alloy belonging to a Cu—Ni—Si type, for example, but it is not limited thereto.

Particularly, in order to fabricate a metal base material in which a sum of area ratios R1, R2 and R3 is greater than or equal to 15%, where R1, R2 and R3 are area ratios of crystal grains oriented in Cube orientation, RDW orientation, and Goss orientation, respectively, in which a (100) plane is facing towards the RD direction, it is necessary to promote, in each step of heat treatment and rolling, nucleation of an orientation which requires to be finally controlled and to promote nucleation and growth of a sacrifice orientation which contributes to orientation growth by being taken in.

The copper alloy of plate 41 may be, for example, Cu—Ni—Si alloys, Cu—Cr alloys, Cu—Zr alloys and Cu—Sn alloys, and may also be the aforementioned alloys containing added elements, such as a Cu—Ni—Si—Sn—Zn—Mg alloy, a Cu—Cr—Sn—Zn alloy, a Cu—Sn—P alloy, and a Cu—Cr—Zr alloy.

In a case where the plate 41 is composed of a copper alloy other than the Cu—Ni—Si—Sn—Zn—Mg alloys, e.g., in a case of Cu—Sn—P alloys, other manufacturing methods may be performed. As shown in another production method of FIG. 7, at first, a metal ingot of a copper alloy is cast (step S71), then, hot rolling is performed at a temperature higher than the heat treatment temperature (step S72), and thereafter, a cold rolling is performed (step S73). Then, a recrystallization process (step S74) and a finish rolling is performed (step S75) to manufacture a plate of the desired thickness.

Figure 7:
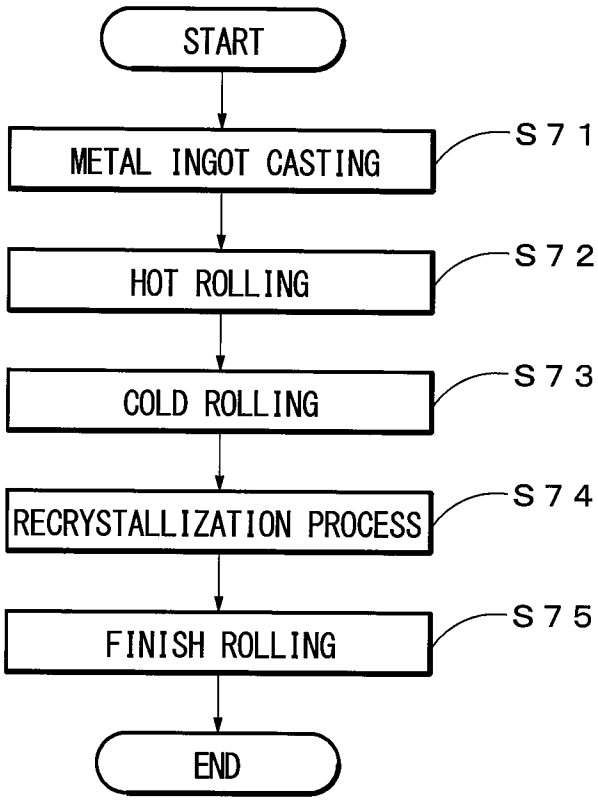
FIG. 7 is a flow chart showing other example of a forming process of the base material of the metal member of FIG. 2.

According to the manufacturing method of FIGS. 6 and 7, the plate 41 composed of the metal base material (or the metal member) having the texture in which the sum of area ratios R1, R2 and R3 specified by the present disclosure is greater than or equal to 15% can be manufactured.

As described above, according to the present embodiment, in the plate 41 for fabricating the tubular crimp portion 30, by making a sum of area ratios R1, R2 and R3 of crystal grains in a metal base material oriented in Cube orientation, RDW orientation, and Goss orientation in which a (100) plane is facing towards the RD direction be greater than or equal to 15%, a proportion of a columnar crystal that grows parallel to a width direction of the belt-shaped weld portion 51 increases and a strain at the weld portion decreases. In other words, by intentionally orienting the crystal grains such that a total of area ratios R1, R2, and R3 is greater than or equal to the predetermined value, columnar crystals growing from the butted portion 47 during the welding will be more easily facing in a certain direction, and as a result, it becomes a weld metal structure that has a less strain during upon solidification than in the related art. Particularly, when crystal grains are in Cube orientation, in RDW orientation or in Goss orientation, since columnar crystals grow parallel to a width direction of the belt-shaped weld portion 51, a strain and a residual stress in the weld portion is reduced. Therefore, cracks do not occur in the weld portion after the crimping of the conductor and adhesion between the tubular crimp portion and an electric wire can be improved, and reliability can be maintained for a long-term.

In the foregoing, the terminal of the aforementioned embodiment and a manufacturing method thereof were described, but the present disclosure is not limited to the embodiment of the description, and various modifications and alterations may be made without departing from the scope and sprit of the present disclosure.

Figure 8:
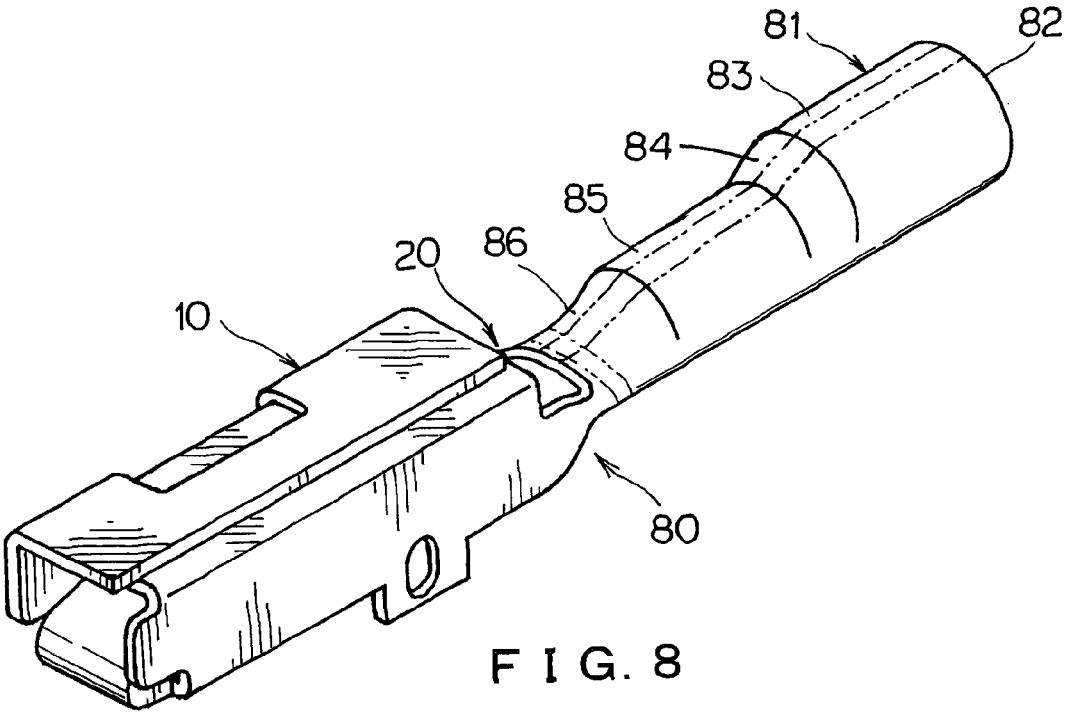
FIG. 8 is a perspective view showing a variant of the terminal according to the present embodiment.

For example, FIG. 1 shows a state where the terminal 40 is crimped with the electric wire 3. However, as shown in FIG. 8, before being crimped with an electric wire, a terminal 80 may have a stepped configuration in the tubular crimp portion. Specifically, a tubular crimp portion 81 is a tubular member that is closed at a transition portion 20 side and that may include a coating crimp portion 83 that is crimped with an insulation coating of an electric wire, not shown, a reduced-diameter portion 84 having a diameter that reduces from an insertion opening 82 side to a transition portion 20 side, a conductor crimp portion 85 that is crimped with a conductor of the electric wire 3, a reduced-diameter portion 86 having a diameter that further reduces from the insertion opening 82 side to the transition portion 20 side and an end portion closed by welding.

With the tubular crimp portion 81 having a stepped shape, when the coating of the end portion of the electric wire is removed and the end portion is inserted into the tubular crimp portion 81, the insulation coating of the electric wire is engaged with the reduced-diameter portion 84, and thereby the insulation coating is located immediately under the coating crimp portion 83 and the electric wire is located immediately under the conductor crimp portion 85. Therefore, since the positioning of the electric wire end portion can be performed easily, crimping of the coating crimp portion 83 and the insulation coating and crimping of the conductor crimp portion 85 and the conductor can be performed positively. Thus both a good water-stop capability and an electric connection can be achieved and a good adhesion is achieved.

The terminal shown in FIG. 1 is a female terminal having a box-shaped connector portion 10, but it is not limited thereto and the connector portion may be a male terminal as shown in FIG. 9. Specifically, it may be provided with a tubular crimp portion 91 crimped with an electric wire, not shown, and a connector portion 93 provided integrally with the tubular crimp portion via a transition portion 92 and electrically connected to an external terminal, not shown. The connector portion 93 has an elongated connecting portion 93*a* and is electrically connected to the female terminal with the connecting portion being inserted along a longitudinal direction of the female terminal, not shown, which is an external terminal.

EXAMPLES

Examples of the present disclosure will described below.

Example 1

Using a Cu-2.3% Ni-0.6% Si-0.15% Sn-0.5% Zn-0.1% Mg alloy, a plate was fabricated with process I described below.

Example 2

Using a Cu-0.27% Cr-0.25% Sn-0.2% Zn alloy, a plate was fabricated with process I described below.

Example 3

Using a Cu-0.15% Sn-trace amount P alloy, a plate was fabricated with process II described below.

Process I: Casting→heat treatment (600° C., 5 h)→heat to 850° C. and perform hot rolling (rolling reduction 83%)→cold rolling (rolling reduction 95%)→solution (825° C., 15 s)→aging treatment (460° C., 2 h)

Process II: Casting→heat to 800° C. and perform hot rolling (rolling reduction 83%)→cold rolling (rolling reduction 92%)→recrystallization process (400° C., 2 h)→finish rolling (reduction 40%)

Comparative Example 1

Using a Cu-2.3% Ni-0.6% Si-0.15% Sn-0.5% Zn-0.1% Mg alloy, a plate was fabricated with process III described below, which was different from Example 1.

Comparative Example 2

Using a Cu-0.27% Cr-0.25% Sn-0.2% Zn alloy, a plate was fabricated with process III, which was different from Example 2.

Comparative Example 3

Using a Cu-0.15% Sn-trace amount P alloy, a plate was fabricated with process IV described below, which was different from Example 3.

Process III: Casting→heat to 950° C. and perform hot rolling (rolling reduction 67%)→cold rolling (rolling reduction 98%)→solution treatment (800° C., 15 s)→aging treatment (460° C., 2 h)

Process IV: Casting→heat to 900° C. and perform hot rolling (rolling reduction 67%)→cold rolling (rolling reduction 96%)→recrystallization process (400° C., 2 h)→finish rolling (rolling reduction 40%)

The plates fabricated with the aforementioned Examples 1 to 3 and Comparative Examples 1 to 3 were pressed into shapes of terminals, tubular bodies to be tubular crimp portions were laser welded and thereafter crimped with electric wires. Coated electric wires each having a conductor made of an aluminum alloy were used as the electric wires. Then, a male female fitting terminal having a male tab width of 2.3 mm was made.

Then, Examples 1 to 3 and Comparative Examples 1 to 3 were measured and evaluated with the following method.

At first, by EBSD method, measurement was carried out under a condition in which a measurement area is a square with each sides being approximately 500 μm and a scan step of 0.5 μm. Using the data in an orientation analysis performed by a software "Orientation Imaging Microscopy v5" (product name) manufactured by EDAX TSL corporation, an area of an atom plane of a crystal grain having a deviation angle within ±10 degrees from Cube orientation and an area of an atom plane of a crystal grain having a deviation angle within ±10 degrees from RDW orientation obtained and a value obtained by dividing the aforementioned areas by a total measurement area and multiplied by 100 was calculated as "Cube orientation+RDW orientation+Goss orientation (%)". Also, for each of Examples and Comparative Examples, a residual strain (%) in the weld portion was measured.

Measurement of a residual strain was measured by an X-ray stress measurement method. At first, resin was embedded in a welding longitudinal direction of the laser welded terminal, and polished until a mirror finished surface appeared. From the cross section, an X-ray diffraction contour was obtained based on Bragg's law. As a measurement condition, defining an angle formed between a normal to a sample plane normal and a normal to a lattice plane as a ψ (psi) angle, an X-ray was irradiated from several points of ψ angle and diffraction line intensity distribution measurement was performed for each of them. An angle of diffraction 2θ showing a peak was taken as 2θ for each ψ angle, and plotted on a graph with an axis of ordinate 2θ and an axis of abscissa (sin ψ)^2, and each point was connected with a straight line by a least square method and a gradient M was obtained, and a stress σ of a surface layer was calculated using σ=K·M. K is a stress constant which is value obtained from an elastic constant, Poisson's ratio, and an angle of diffraction in an unstressed state of a measured material, but since a residual strain which is a result of the measurement is expressed as a ratio, it was assumed as a value that is eliminated when a division is carried out. Note that a numerical value measured in Comparative Examples in which there is no accumulation of crystal orientation was taken as 100%, and Examples were obtained by converting the ratio to Comparative Examples that use the alloy into %.

In an anti-corrosion seal test, after crimping an electric wire, a positive pressure of 10 kPa to 50 kPa was applied from an electric wire portion side to check whether there is an air leak, and a sample that did not show an air leak was evaluated as "Accept" and a sample that showed an air leak was evaluated as "Reject".

The aforementioned calculation results, measurement results and evaluation results of the anti-corrosion seal test are shown in Table 1.

TABLE 1

| | COMPOSITION | PROCESS | SUM OF W ORIENTATION + RDW ORIENTATION + GOSS ORIENTATION (%) | RESIDUAL STRAIN IN WELDED PORTION (%) | ANTI-CORROSION SEALING TEST |
|---|---|---|---|---|---|
| EXAMPLE 1 | Cu—2.3% Ni—0.6% Si—0.15% Sn—0.5% Zn—0.1% Mg | I | 25 | 25 | ACCEPT |
| EXAMPLE 2 | Cu—0.27% Ni—0.25% Sn—0.2% Zn | I | 35 | 17 | ACCEPT |
| EXAMPLE 3 | Cu—0.15% Sn-TRACE P | II | 45 | 35 | ACCEPT |
| COMPARATIVE EXAMPLE 1 | Cu—2.3% Ni—0.6% Si—0.15% Sn—0.5% Zn—0.1% Mg | III | 2 | 100 | REJECT |
| COMPARATIVE EXAMPLE 2 | Cu—0.27% Ni—0.25% Sn—0.2% Zn | III | 3 | 100 | REJECT |
| COMPARATIVE EXAMPLE 3 | Cu—0.15% Sn-TRACE P | IV | 5 | 100 | REJECT |

It can be seen from the results in Table 1 that, when the plate is fabricated using a Cu-2.3% Ni-0.6% Si-0.15% Sn-0.5% Zn-0.1% Mg alloy and performing process I, a sum of area ratios R1, R2 and R3 of crystal grains oriented in Cube orientation, RDW orientation, and Goss orientation can be greater than or equal to 25%, and adhesion between the tubular crimp portion and the electric wire can be improved.

Further, it can be seen that when the plate is fabricated using a Cu-0.27% Cr-0.25% Sn-0.2% Zn alloy with process I, a sum of area ratios R1, R2 and R3 of crystal grains oriented in Cube orientation, RDW orientation, and Goss orientation can be greater than or equal to 35%, and adhesion between the tubular crimp portion and the electric wire can be improved.

Further, it can be seen that when the plate is fabricated using a Cu-0.15% Sn-trace amount P alloy with process II, a sum of area ratios R1, R2 and R3 of crystal grains oriented in Cube orientation, RDW orientation, and Goss orientation can be greater than or equal to 45%, and adhesion between the tubular crimp portion and the electric wire can be improved.

What is claimed is:

1. A terminal comprising:

a connector portion electrically connectable to an external terminal;

a tubular crimp portion extending from the connector portion, the tubular crimp portion being integral with the connector portion or coupled to the connector portion distinct therefrom, the tubular crimp portion being adapted to be crimped onto an electric wire, the tubular crimp portion having a longitudinal direction and a circumferential direction; and a transition portion that couples the connector portion and the tubular crimp portion, wherein the tubular crimp portion comprises one of a metal base material and a metal member having the metal base material, the metal base material being composed of one of copper and a copper alloy, the tubular crimp portion is a tubular member having a closed transition portion and an electric wire insertion opening side, the electric wire insertion opening side being adapted to receive and encompass a conductor end portion of an electric wire, the electric wire insertion opening side having a first width and the transition portion having a second width, the second width being less than the first width, the tubular crimp portion has a belt-shaped weld portion formed along a direction that is substantially the same as the longitudinal direction of the tubular crimp portion, a RD-direction of the metal base material being substantially aligned with the circumferential direction of the tubular crimp portion, and a sum of area ratios R1, R2 and R3 is greater than or equal to 15%, where R1, R2 and R3 are area ratios of crystal grains in the metal base material oriented substantially in Cube orientation, RDW orientation, and Goss orientation, respectively, facing a (100) plane of a face centered cubic lattice with respect to the RD-direction.

2. The terminal according to claim 1, wherein the Cube-oriented crystal grain includes a crystal grain at a deviation angle of ±10% from Cube orientation, the RDW-oriented crystal grain includes a crystal grain at a deviation angle of ±10% from RDW orientation, and the Goss-oriented crystal grain includes a crystal grain at a deviation angle of ±10% from Goss orientation.

3. The terminal according to claim 1, wherein the copper alloy is one of a Cu—Ni—Si alloy, a Cu—Cr alloy, a Cu—Zr alloy, and a Cu—Sn alloy.

4. The terminal according to claim 1, wherein the tubular crimp portion has a coating crimp portion adapted to be crimped onto an insulation coating of an electric wire and a conductor crimp portion adapted to be crimped onto a conductor of an electric wire, the tubular crimp portion having a first tapering width region that decreases in width away from a coating crimp portion side towards a conductor crimp portion side, the tubular crimp portion having a second tapering width region that decreases in width away from the conductor crimp portion side and toward the transition portion.

5. The terminal according to claim 1, wherein an end portion of the transition portion of the tubular crimp portion is sealed by a weld.

6. A wire connecting structure comprising:

a terminal; and an electric wire, wherein the terminal includes: a connector portion electrically connectable to an external terminal, a tubular crimp portion that is integral with the connector portion or coupled to the connector portion distinct therefrom, and a transition portion that couples the connector portion and the tubular crimp portion, the tubular crimp portion being crimped onto the electric wire, the tubular crimp portion is formed of one of a metal base material and a metal member having the metal base material, the metal base material being composed of one of copper and a copper alloy, the tubular crimp portion is a tubular member having a closed transition portion—and an electric wire insertion opening side, the electric wire insertion opening side encompassing a conductor end portion of the electric wire, the electric wire insertion opening side having a first width and the transition portion having a second width, the second width being less than the first width, the tubular crimp portion has a belt-shaped weld portion formed along a direction that is substantially the same as the longitudinal direction of the tubular crimp portion, a RD-direction of the metal base material being substantially aligned with the circumferential direction of the tubular crimp portion, and a sum of area ratios R1, R2 and R3 is greater than or equal to 15%, where R1, R2 and R3 are area ratios of crystal grains in the metal base material substantially oriented in Cube orientation, RDW orientation, and Goss orientation, respectively, facing a (100) plane of a face centered cubic lattice with respect to the RD-direction.

7. The wire connecting structure according to claim 6, wherein the conductor end portion of the electric wire is composed of one of aluminum and an aluminum alloy.

8. A method of manufacturing a terminal having a connector portion electrically connectable to an external terminal, a tubular crimp portion being integral with the connector portion or coupled to the connector portion distinct therefrom, and a transition portion that couples the connector portion and the tubular crimp portion, the tubular crimp portion being adapted to be crimped onto an electric wire, the tubular crimp portion having an electric wire insertion opening side, the electric wire insertion opening side having a first width and the transition portion having a second width, the method comprising:

forming a metal base material in which a sum of area ratios R1, R2 and R3 being greater than or equal to 15%, where R1, R2 and R3 are area ratios of crystal grains in the metal base material oriented in Cube orientation, RDW orientation, and Goss orientation, respectively, facing a (100) plane of a face centered cubic lattice with respect to the RD-direction;

pressing the metal base material to form a tubular body in such a manner that a RD-direction of the metal base material is substantially the same as a circumferential direction of the tubular crimp portion; and welding a butted portion of the tubular body to form the tubular crimp portion in such a shape that the tubular body is closed at the transition portion and reduces in width away from the electric wire insertion opening side and towards the transition portion, the tubular crimp portion being formed so as to enable a conductor end portion of an electric wire to be received and encompassed by the electric wire insertion opening side, and forming on the tubular body a belt-shaped weld portion in a direction substantially the same as a longitudinal direction of the tubular body.

9. The method of manufacturing a terminal according to claim 8, further comprising welding and sealing an end portion of the tubular crimp portion opposite to the electric wire insertion opening.

10. A method of manufacturing a terminal having a connector portion electrically connectable to an external terminal, a tubular crimp portion that is integral with the connector portion or coupled to the connector portion distinct therefrom, and a transition portion that couples the connector portion and the tubular crimp portion, the tubular crimp portion being adapted to be crimped onto an electric wire, the method comprising:

forming a metal base material in which a sum of area ratios R1, R2 and R3 is at least equal to 15%, where R1, R2 and R3 are area ratios of crystal grains in the metal base material oriented in Cube orientation, RDW orientation, and Goss orientation, respectively, facing a (100) plane of a face centered cubic lattice with respect to the RD-direction;

providing a metal layer on the metal base material to form a metal member;

pressing the metal member to form a tubular body in such a manner that a RD-direction of the base material is substantially the same as a circumferential direction of a tubular crimp portion; and welding a butted portion of the tubular body to form the tubular crimp portion in such a shape that the tubular body is closed at the transition portion and reduces in width from the electric wire insertion opening side towards the transition portion, the tubular crimp portion being formed so as to enable a conductor end portion of an electric wire to be received and encompassed by the electric wire insertion opening side, and forming on the tubular body a belt-shaped weld portion in a direction substantially the same as a longitudinal direction of the tubular body.

11. The method of manufacturing a terminal according to claim 10, further comprising welding and sealing an end portion of the tubular crimp portion opposite to the electric wire insertion opening.

* * * * *